US007810891B2

(12) United States Patent
Lee et al.

(10) Patent No.: US 7,810,891 B2
(45) Date of Patent: Oct. 12, 2010

(54) REFRIGERATOR HAVING BASKET LIFT APPARATUS

(75) Inventors: Myung-Ryul Lee, Gyeonggi-Do (KR); Seong-Jae Kim, Gyeonggi-Do (KR); Seung-Hwan Oh, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 106 days.

(21) Appl. No.: 11/178,451

(22) Filed: Jul. 12, 2005

(65) Prior Publication Data

US 2006/0103273 A1 May 18, 2006

(30) Foreign Application Priority Data

Oct. 7, 2004 (KR) ..... 10-2004-0080010

(51) Int. Cl.
*A47B 96/04* (2006.01)

(52) U.S. Cl. ..... 312/402; 312/319.8

(58) Field of Classification Search ..... 312/404, 312/333, 298, 299, 306, 310, 312, 334.1, 312/334.4, 334.44, 334.46, 334.27, 334.29, 312/334.31, 334.32, 332.34, 296, 402, 403, 312/334.34

See application file for complete search history.

(56) References Cited

U.S. PATENT DOCUMENTS 2,149,114 A 2/1939 Constantine
2,324,527 A 7/1943 Morrison
2,497,734 A * 2/1950 Kuklich ..... 312/312
2,791,478 A * 5/1957 Page ..... 312/298
2,854,307 A * 9/1958 Londeree et al. ..... 312/247
3,246,939 A 4/1966 Petkwitz et al.
4,711,184 A * 12/1987 Wallin et al. ..... 108/147
4,790,611 A * 12/1988 Craner ..... 312/306
5,586,816 A 12/1996 Geiss, II
5,601,014 A * 2/1997 Stevens et al. ..... 108/7
5,893,615 A * 4/1999 Hendricks ..... 312/71

(Continued)

FOREIGN PATENT DOCUMENTS

AU 2004242444 2/2006

(Continued)

OTHER PUBLICATIONS

English language Abstract of JP 4-359781.

(Continued)

*Primary Examiner*—Janet M Wilkens
*Assistant Examiner*—Matthew W Ing
(74) *Attorney, Agent, or Firm*—Ked & Associates LLP

(57) ABSTRACT

A refrigerator includes a main body having cooling chambers for keeping food items therein, a base frame disposed to be movable in outward and inward directions in a lower cooling chamber disposed at a lower portion of the main body, and having a basket door at its front side, a lift frame disposed on the base frame, on which the basket is put, a fluid pressure cylinder mounted at the base frame and connected to the lift frame to lift the lift frame, and an fluid compressor connected to the fluid pressure cylinder by an fluid supply pipe and supplying compressed fluid to the fluid pressure cylinder. Accordingly, as the basket is lifted when being drawn out, a user can take out food items kept in the basket without bending his/her back, which enhances user's convenience.

9 Claims, 10 Drawing Sheets

U.S. PATENT DOCUMENTS

| | | | | |
|---|---|---|---|---|
| 6,000,770 | A * | 12/1999 | Frich | 312/319.7 |
| 6,021,722 | A * | 2/2000 | Raycraft | 108/147 |
| 6,471,311 | B1 * | 10/2002 | Snyder | 312/247 |
| 2003/0132689 | A1 * | 7/2003 | Shin | 312/405 |
| 2004/0100168 | A1 | 5/2004 | Choi | |
| 2005/0073225 | A1 | 4/2005 | Kwon et al. | |

FOREIGN PATENT DOCUMENTS

| | | | |
|---|---|---|---|
| AU | 2005201411 | | 2/2006 |
| AU | 2005201538 | | 2/2006 |
| DE | 29701227 | | 6/1997 |
| GB | 2406633 | | 4/2005 |
| JP | 4-359781 | | 12/1992 |
| JP | 5-296647 | | 11/1993 |
| JP | 5296647 | * | 11/1993 |
| KR | 10-1998-026269 | | 7/1998 |
| KR | 2004-6496 | | 1/2004 |
| KR | 1020040006496 | * | 1/2004 |

OTHER PUBLICATIONS

English language Abstract of JP 5-296647.
English language Abstract of 2004-6496.
U.S. Appl. No. 11/178,438 to Jeong et al., filed Jul. 12, 2005.
U.S. Appl. No. 11/178,452 to Oh et al., filed Jul. 12, 2005.
U.S. Appl. No. 11/101,584 to Oh et al., filed Apr. 8, 2005.
U.S. Appl. No. 11/104,539 to Oh et al., filed Apr. 13, 2005.
English language Abstract of KR 10-1998-026269.

* cited by examiner

REFRIGERATOR HAVING BASKET LIFT APPARATUS

BACKGROUND OF THE INVENTION

1. Field of the Invention

The present invention relates to a refrigerator having a basket lift apparatus and particularly, to a refrigerator having a basket lift apparatus for lifting up a basket for keeping food items therein, which enhances user's convenience.

2. Description of the Background Art

FIG. 1 is a perspective view of a refrigerator in accordance with the conventional art, and FIG. 2 is a sectional view of a lower region of a refrigerator for showing a state that a basket is received in a main body.

The conventional refrigerator includes a main body 11 having an opened front side and a receiving space, an upper cooling chamber 21 disposed at an upper side of the main body 11, having a pair of upper ('French' style side-by-side) doors 23 respectively opening swingably at both sides, for keeping food items stored therein, and a lower cooling chamber 31 disposed at a lower side of the main body 11, separated by a barrier wall 17 from the upper cooling chamber 21 and having a lower door 33 opening slidably outwardly.

A machine room 13, which includes a compressor 15 and other components for generating cooling fluid supplied to the upper cooling chamber 21 and the lower cooling chamber 31, is installed at a rear portion of the main body 11.

A basket 35 for receiving food items therein is slidably disposed at the lower cooling chamber 31, and the lower door 33 is fixed at the front side of the basket 35. Accordingly, when the lower door 33 is pulled out, the basket 35 is thereby opened, and when the lower door 33 is pushed in, the basket 35 is thereby closed. Here, a guide rail 37 is respectively installed between each of the outer sides of the basket 35 and inner sides of the lower cooling chamber 31 to guide the basket 35 to be slid in the inward/outward directions.

A plurality of drawers 38 for keeping food items therein are provided above the basket 35 so as to be slidingly opened.

In the conventional refrigerator constructed in the aforementioned manner, when a food item kept in the lower cooling chamber 31 needs to be taken out or a food item needs to be put into the lower cooling chamber 31, the lower door 33 is pulled outwardly so that the basket 35 can be slidingly moved and opened. After the food item stored in the basket 35 is taken out or the food item is put into the basket 35, the lower door 33 is pushed inwardly so that the basket 35 can be slidingly closed.

However, the conventional refrigerator having such a structure is disadvantageous in that, because the installation position of the basket is too low, a user must lower his/her posture, that is, for example, the user must bend his/her back or crouch down in order to put in or take out the food items, causing user's inconvenience.

SUMMARY OF THE INVENTION

Therefore, an object of the present invention is to provide a refrigerator having a basket lift apparatus capable of heighten a position of the basket by lifting up a basket disposed in a cooling chamber, which enhances user's convenience.

To achieve these and other advantages and in accordance with the purpose of the present invention, as embodied and broadly described herein, there is provided a refrigerator comprising: a main body having cooling chambers for keeping food items therein, a base frame disposed to be movable inwardly/outwardly in a lower cooling chamber disposed at a lower portion of the main body, and having a basket door at its front side, a lift frame disposed on the base frame, on which the basket is put, a fluid pressure cylinder mounted at the base frame and connected to the lift frame to lift the lift frame, and an fluid compressor connected to the fluid pressure cylinder by an fluid supply pipe and supplying compressed fluid to the fluid pressure cylinder.

The refrigerator further comprises at least one lift rail installed at a rear surface of the basket door and guiding the lift frame to be lifted up and down.

An open and close valve for handling an opening and closing operation of the fluid supply pipe is installed at the fluid supply pipe.

The refrigerator further comprises a control unit controlling the open and close valve and the fluid compressor when the basket is drawn out so as to lift up the lift frame. The control unit comprises: a switch manipulated by a user; a first sensor mounted at an upper end of the door and sensing a maximum lifted state of the lift frame; a second sensor mounted at a lower end of the door and sensing a bottom lowered state of the lift frame; and a controller controlling the driving of the open and close valve and the fluid compressor according to signals applied from the switch and the first and second sensors.

To achieve these and other advantages and in accordance with the purpose of the present invention, as embodied and broadly described herein, there is provided a refrigerator comprising: a main body having an cooling chamber with an opened upper side; a lift frame installed to be vertically liftable at the cooling chamber, on which a basket for keeping food items therein is put; at least one fluid pressure cylinder lifting the lift frame; and an fluid compressor connected to the fluid pressure cylinder by an fluid supply pipe and supplying compressed fluid to the fluid pressure cylinder.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There can be several embodiments of the refrigerator having a basket lift apparatus, of which the most preferred ones will be described.

Figure 1:
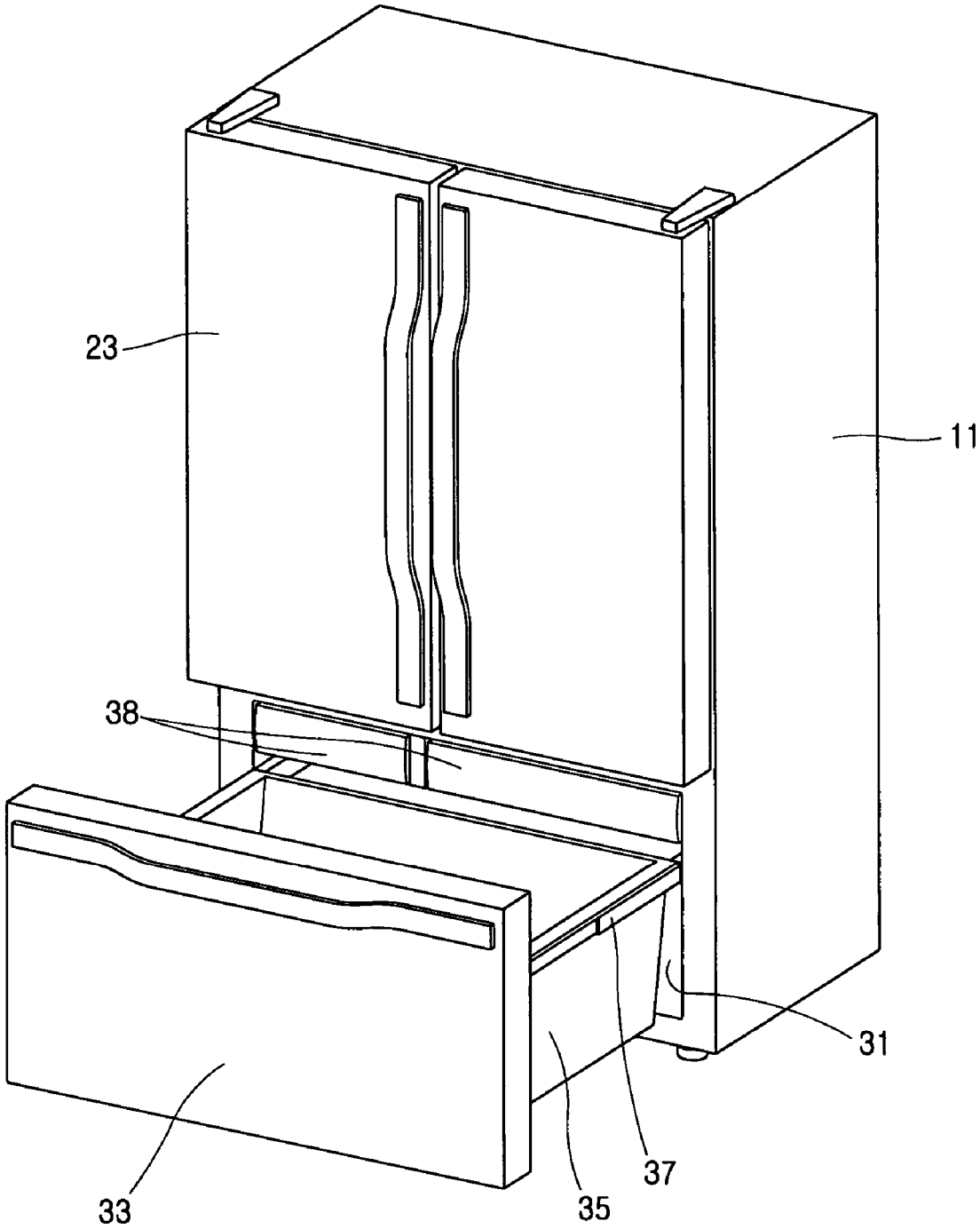
FIG. 1 CONVENTIONAL ART
FIG. 1 is a perspective view of a refrigerator in accordance with the conventional art.
Figure 2:
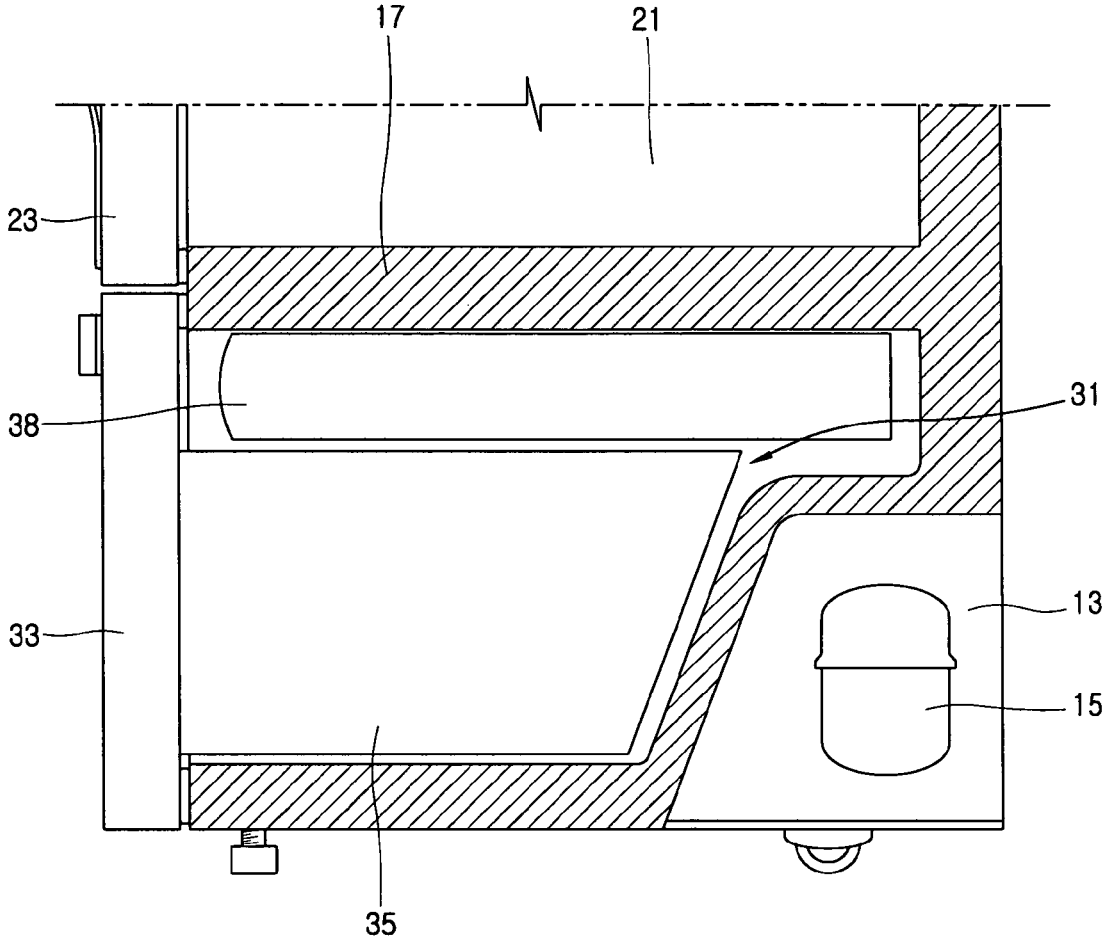
FIG. 2 CONVENTIONAL ART
FIG. 2 is a sectional view of a lower portion of the refrigerator in accordance with the conventional art.
Figure 3:
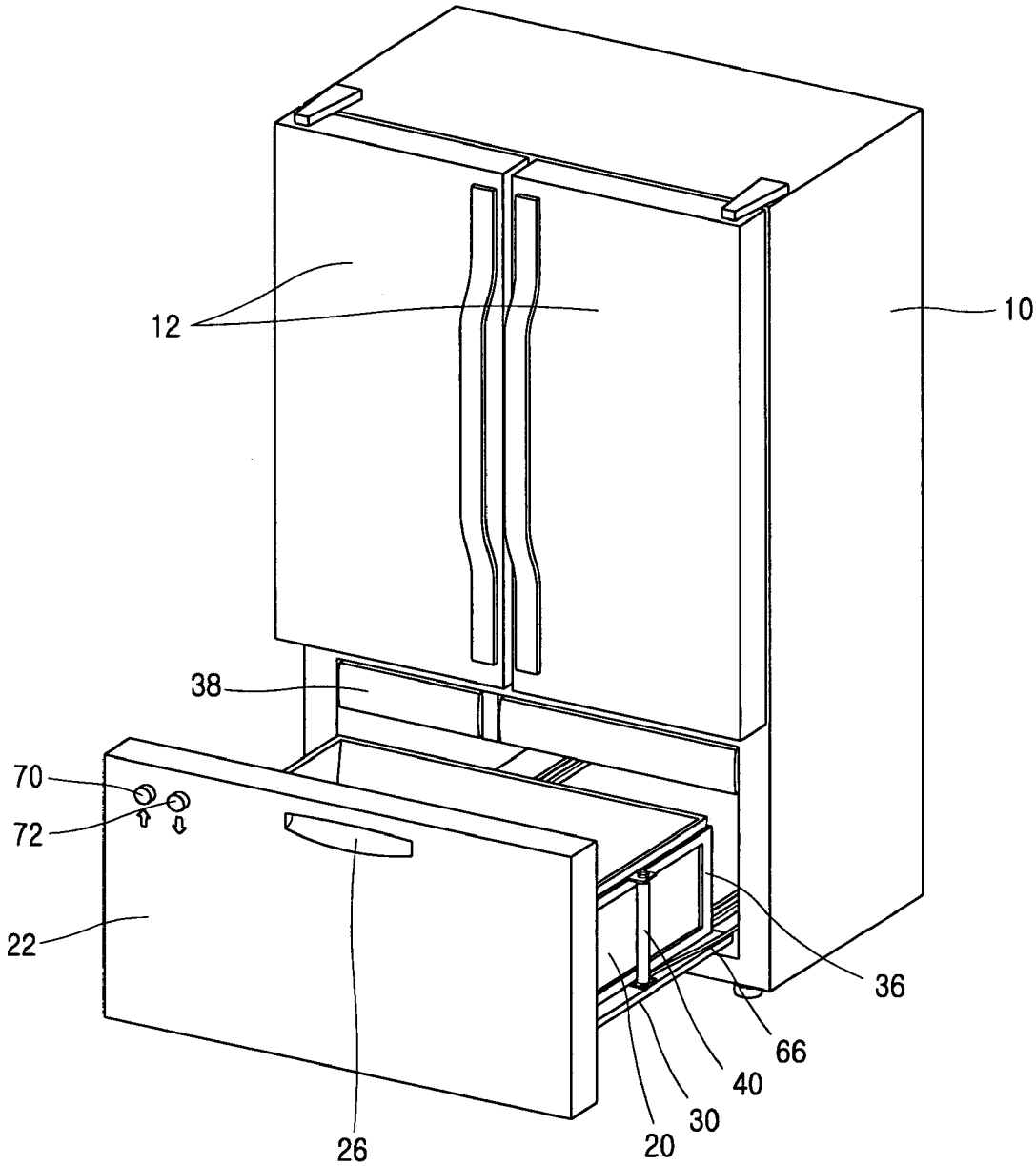
FIG. 3 is a perspective view of a refrigerator with its basket opened in accordance with a first embodiment of the present invention.
Figure 4:
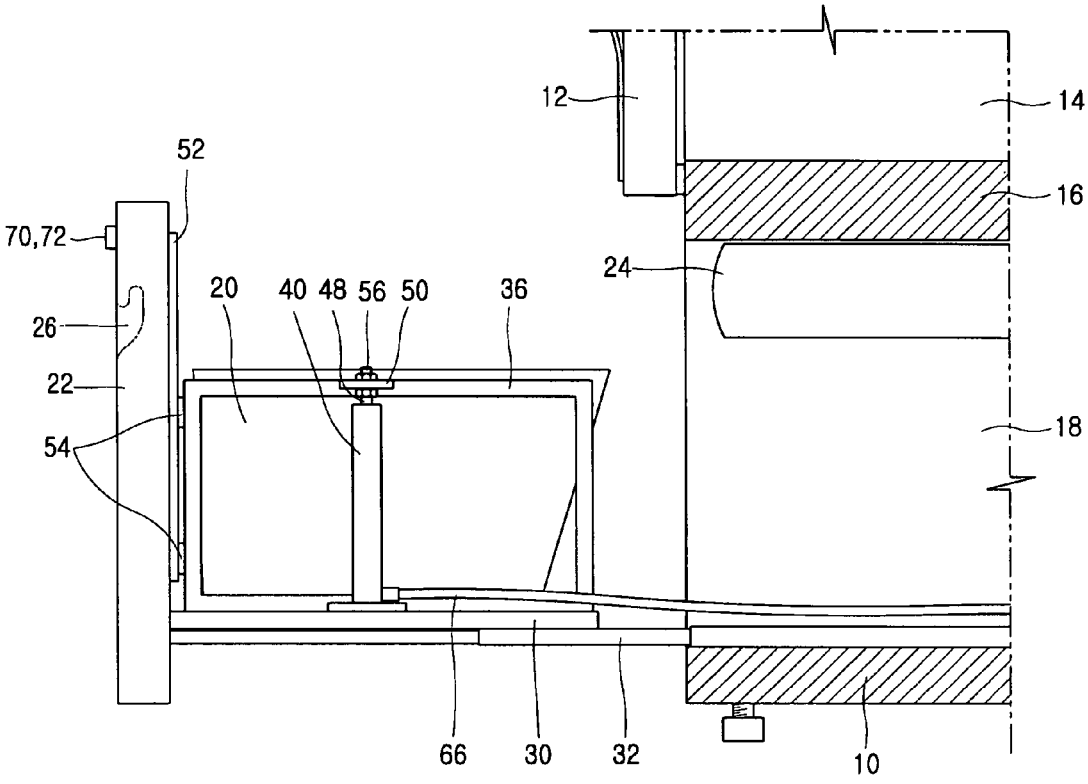
FIG. 4 is a side view which illustrates a basket lift apparatus of the refrigerator in accordance with the first embodiment of the present invention.

FIG. 3 is a perspective view of a refrigerator in accordance with a first embodiment of the present invention, and FIG. 4 is a side view of a basket lift apparatus of the refrigerator in accordance with the first embodiment of the present invention.

The refrigerator in accordance with the present invention includes a main body 10 having a receiving space therein, an upper cooling chamber 14 disposed at an upper portion of the main body 10 and having a pair of doors 12 opening at both sides, a lower cooling chamber 18 separated by a barrier wall 16 from the upper cooling chamber 14 and disposed at a lower portion of the main body 10, a basket 20 disposed to be slidable inwardly/outwardly at the lower cooling chamber 18 for keeping food items therein, and a lift apparatus lifting the basket 20 upward when the basket 20 is drawn out.

Here, the upper cooling chamber 14 is preferably used as a refrigerating chamber for keeping refrigerated food items, and the lower cooling chamber 18 is preferably used as a freezing chamber for keeping frozen food items.

A basket door 22 is disposed at a front side of the lower cooling chamber 18 and pushes in or draws out the basket 20 while being moved inwardly/outwardly of the main body 10. A plurality of drawers 24 are disposed at an upper portion of the lower cooling chamber 18, to keep food items and can be drawn in or out.

The basket door 22 includes a handle 26 at its front side. At an inner side of the basket door 22, a base frame 30 which the basket 20 is put on is mounted, and a pair of guide rails 32 are installed between a bottom surface of the lower cooling chamber 18 and a lower surface of the base frame 30, to thereby guide the base frame 30 to be slid inwardly/outwardly of the main body 10.

Figure 5:
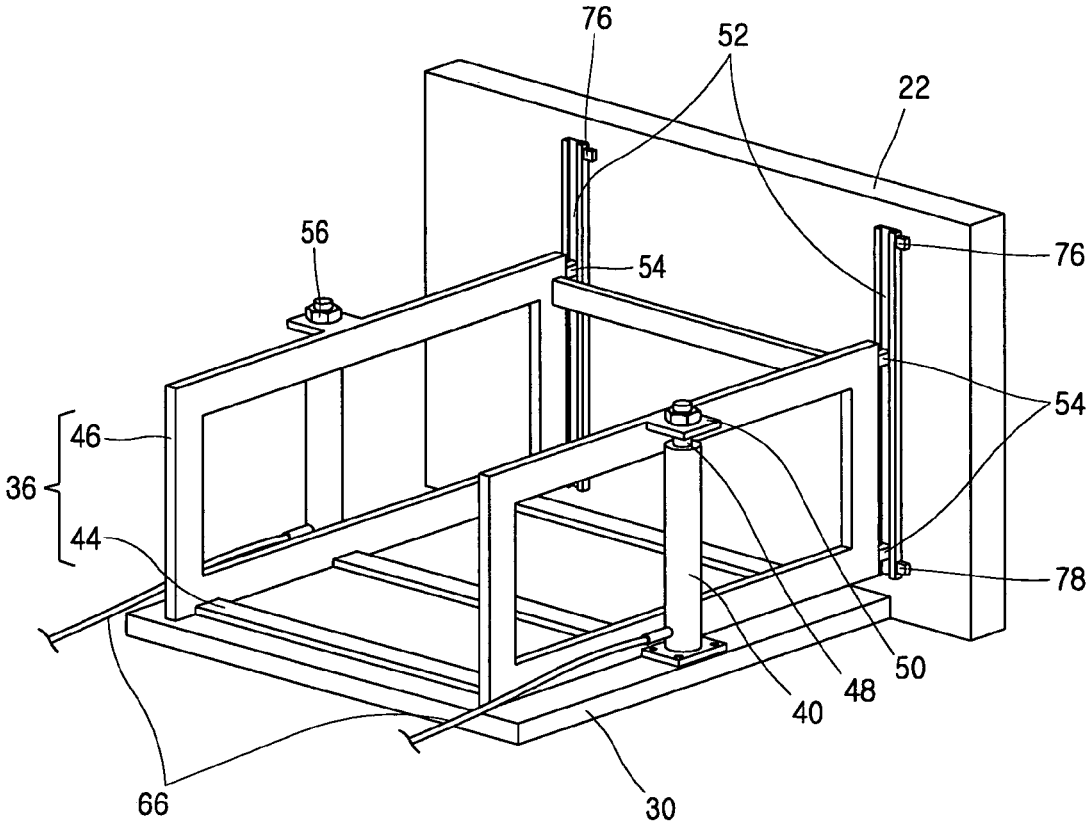
FIG. 5 is a perspective view of the basket lift apparatus of the refrigerator in accordance with the first embodiment of the present invention.
Figure 6:
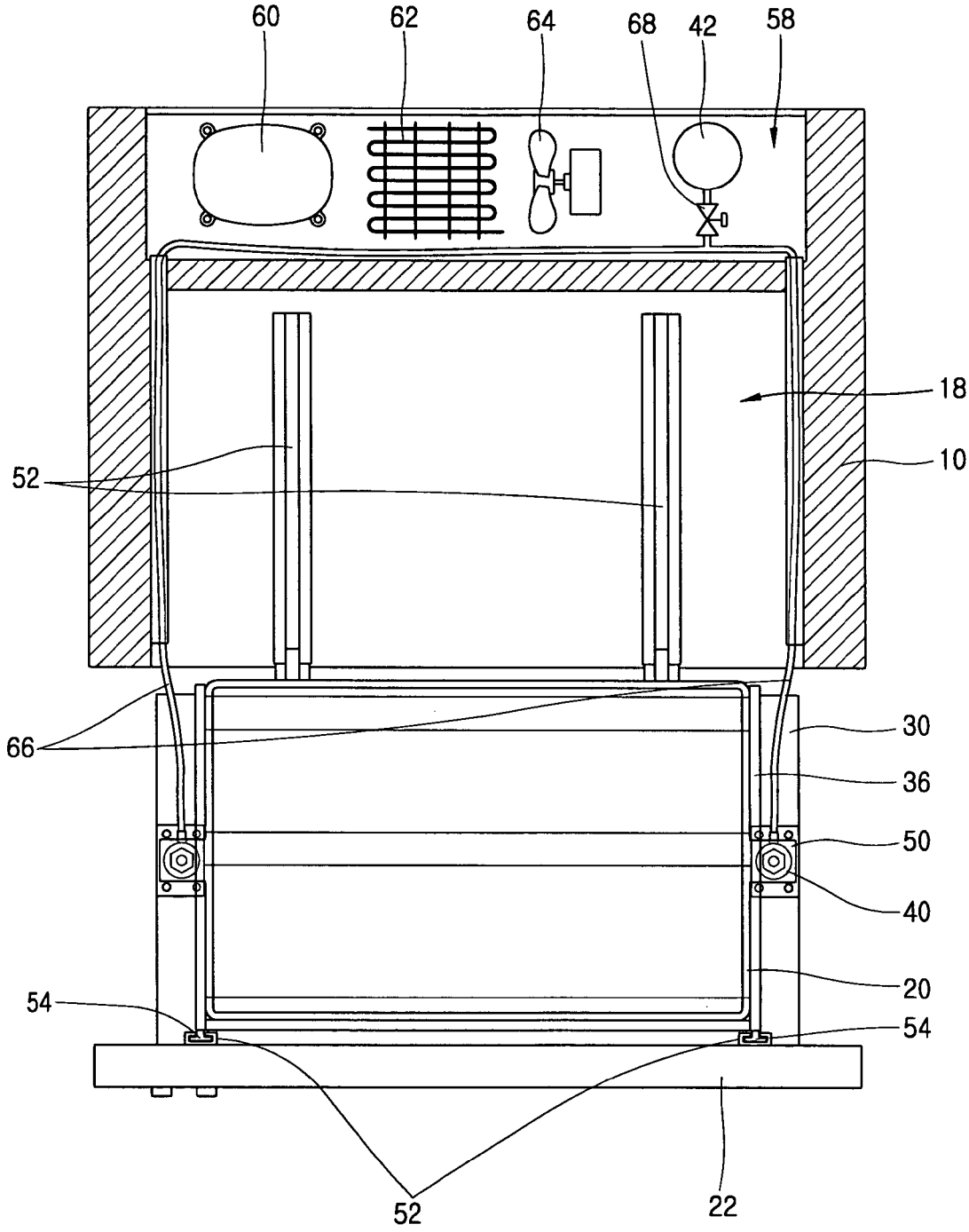
FIG. 6 is a view which illustrates an upper side of the basket lift apparatus of the refrigerator in accordance with the first embodiment of the present invention.

FIG. 5 is a perspective view of a basket lift apparatus of the refrigerator in accordance with the first embodiment of the present invention, and FIG. 6 is a view which illustrates an upper side of the basket lift apparatus of the refrigerator in accordance with the first embodiment of the present invention.

The lift apparatus includes a lift frame 36, on which the basket 20 is placed, disposed above the base frame 30, at least one fluid pressure cylinder 40 fixed to the base frame 30 and connected to the lift frame 36 to lift or lower the lift frame 36, and an fluid compressor 42 supplying compressed fluid to the fluid pressure cylinder 40.

The lift frame 36 includes a lower plate 44 on which the basket 20 is put, and a pair of side plates 46 respectively extending vertically from both sides of the lower plate 44. A mounting portion 50 to which an operation rod 48 of the fluid pressure cylinder 40 is fixed is formed at each side plate 46.

At least one lift rail 52 is installed at a rear side of the basket door 22 and guides the lift frame 36 to be moved in a vertical direction. Namely, the lift rails 52 are constructed as a pair and vertically fixed to the rear surface of the basket door 22, and a guide protrusion 54 formed at the rear side of the lift frame 36 is inserted in the lift rail 52, such that the lift rail 52 supports the vertical movement of the lift frame 36.

The fluid pressure cylinders 40 are constructed as a pfluid and fixed to both sides of the base frame 30. Each fluid pressure cylinder 40 has therein a space in which the compressed fluid is introduced, and the operation rod 48 is mounted vertically movably at an upper side of the fluid pressure cylinder 40. The upper end of the operation rod 48 is engaged with the mounting portion 50 formed at each side of the lift frame 37 by a bolt 56.

A machine room 58 is formed at a rear side of the main body 10. A compressor 60 for compressing a refrigerant, a condenser 62 for radiating heat of the compressed refrigerant, and a cooling fan 64 for blowing fluid for a heat-exchange of the condenser 62 are installed in the machine room 58. Also, an fluid compressor 42 generating compressed fluid provided to the fluid pressure cylinder 40 is installed in the machine room 58.

The fluid compressor 42 is connected to the fluid pressure cylinder 40 by an fluid supply pipe 66, and an open and close valve 68 for handling an opening and closing operation of the fluid supply pipe 66 is installed at the fluid supply pipe 66.

Preferably, the open and close valve 68 is formed in a solenoid type that opens/closes the fluid supply pipe 66 when power is applied thereto, and is operated according to an electric signal applied thereto from a control unit.

Figure 7:
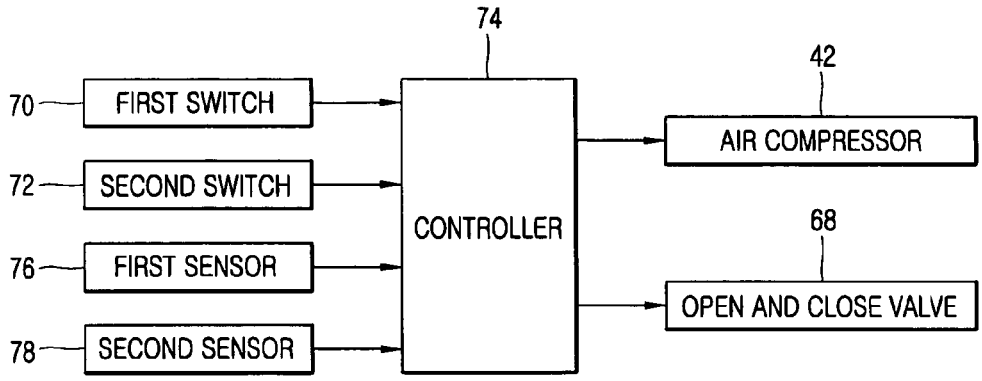
FIG. 7 is a block diagram which illustrates a control unit of the basket lift apparatus in accordance with the first embodiment of the present invention.

As shown in FIG. 7, the control unit includes switches 70 and 72 mounted at a front side of the basket door 22 and manipulated by a user, a first sensor 76 installed at an upper end of the lift rail 52 and sensing a maximum lifted state of the lift frame 36, a second sensor 78 mounted at a lower end of the lift rail 52 and sensing a bottom lowered state of the lift frame 36, and a controller 74 operating the open and close valve 68 and the fluid compressor 42 according to signals applied from the switches 70 and 72, the first sensor 76 and the second sensor 78.

As for the switches 70 and 72, a first switch 70 is pressed by a user to lift the basket 20 upward, and a second switch 72 is pressed by a user to lower the basket 20 downward.

An operation of the lift apparatus in accordance with the first embodiment of the present invention having such a structure will now be described.

Figure 8:
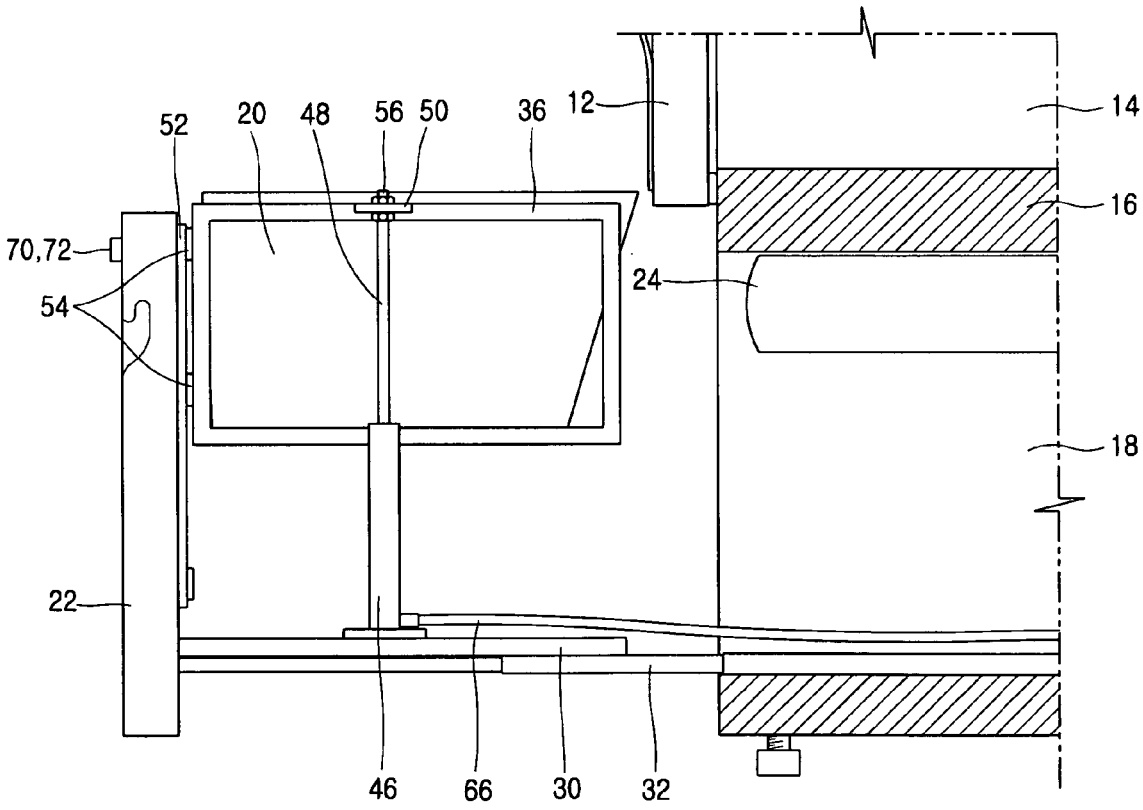
FIG. 8 is a view which illustrates an operation of the basket lift apparatus in accordance with the first embodiment of the present invention.

FIG. 8 is an operation state of the basket lift apparatus in accordance with the first embodiment of the present invention.

First, when the user wants to take out a food item kept in the basket 20, the user pulls the basket door 22 in an outward direction to draw the basket 20 out of the lower cooling chamber 18.

Then, if the user presses the first switch 70 installed at the basket door 22, the lift frame 36 is lifted up. Namely, when the user presses the first switch 70, the controller 74 operates the fluid compressor 42 and simultaneously, applies power to the open and close valve 68 to thereby open the fluid supply pipe 66, and the compressed fluid generated in the fluid compressor 42 is supplied to the fluid pressure cylinder 40 through the fluid supply pipe 66. Thus, the operation rod 48 is moved in an upward direction by the compressor fluid being supplied to the fluid pressure cylinder 40, thereby lifting up the lift frame 36 on which the basket 20 is put. When the lift frame 36 reaches the highest point, the first sensor 76 senses that and applies a signal to the controller 74, and the controller 74 having received the signal cuts off power supply to the open and close valve 68 to thereby close the fluid supply pipe 66 and stops the fluid compressor 42. Then, the fluid pressure cylinder 40 is filled with the fluid, thereby maintaining the lifted state of the lift frame 36.

In such a state, when the user presses the second switch 72 after putting a food item in the basket 20 or taking a food item out of the basket 20, the controller 74 applies power to the open and close valve 68 to open the fluid supply pipe 66. Then, the compressed fluid filled in the fluid pressure cylinder 40 is discharged through the fluid supply pipe 66 and thus the lift frame 36 is lowered down by its own weight. When the lift frame 36 is completely lowered, the second sensor 78 applies an electric signal to the controller 74 and accordingly, the controller 74 cuts off power supply to the open and close valve 68, to thereby close the open and close valve 68.

Figure 9:
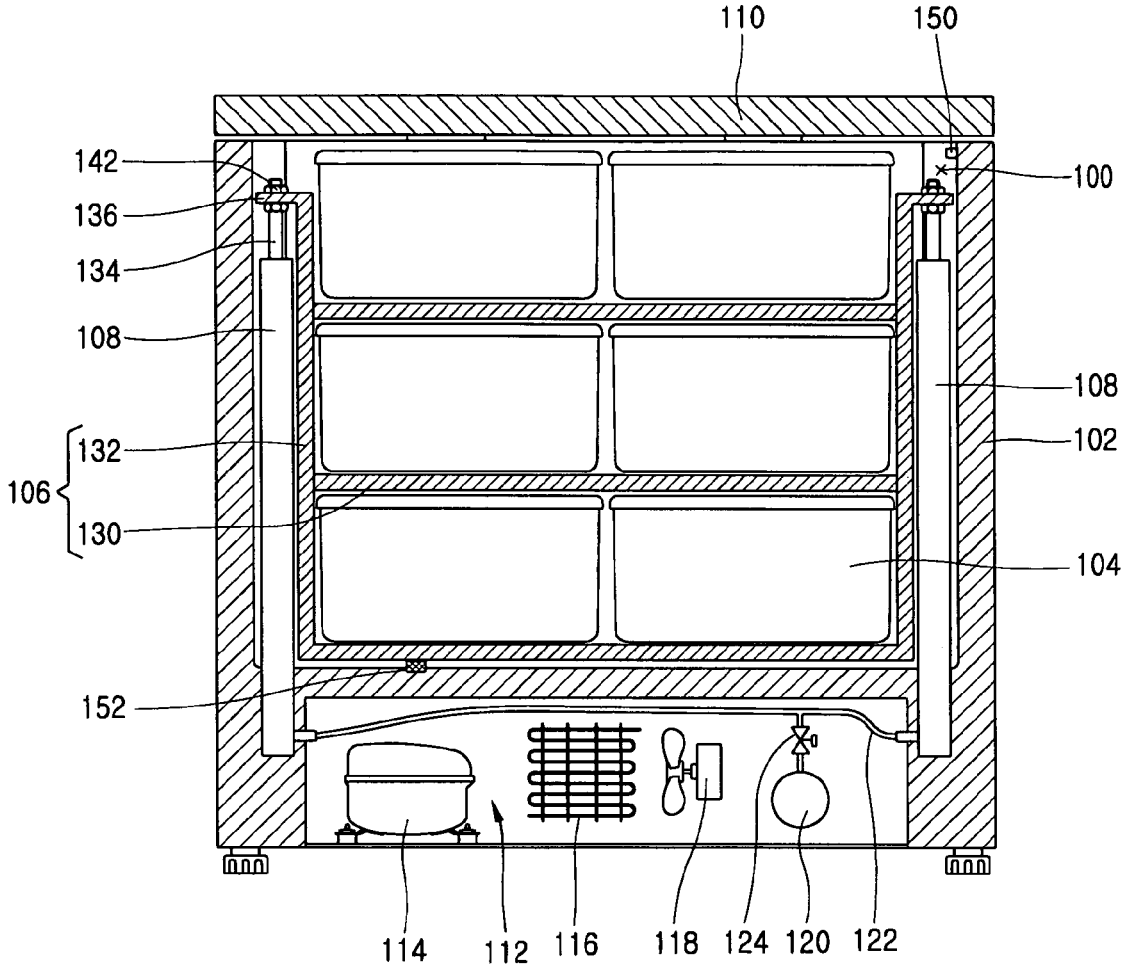
FIG. 9 is a sectional view of a basket lift apparatus in accordance with a second embodiment of the present invention.
Figure 10:
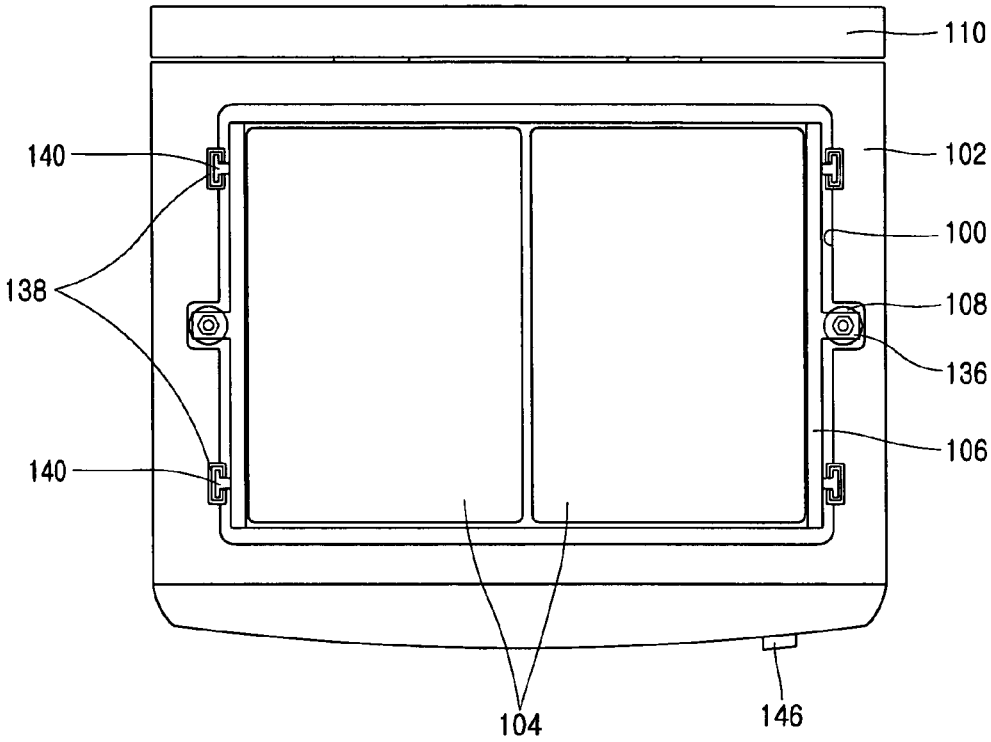
FIG. 10 is a view which illustrates an upper side of the basket lift apparatus in accordance with the second embodiment of the present invention.

FIG. 9 is a sectional view of the refrigerator having a basket lift apparatus in accordance with the second embodiment of the present invention, and FIG. 10 shows an upper side of the refrigerator having the basket lift apparatus in accordance with the second embodiment of the present invention.

The refrigerator in accordance with the second embodiment includes a main body 102 having a cooling chamber 100 with an opened upper side, a lift frame 106, on which a basket 104 for keeping food items therein is put, installed in the cooling chamber 100 and liftable in upward and downward directions, and at least one fluid pressure cylinder 108 lifting up the lift frame 106.

The main body 102 has an opened upper side such that the basket 106 received in the cooling chamber 100 can be drawn out upwardly of the main body 102, and a door 110 is mounted at the opened upper side of the main body 102 to be openable and closable.

A machine room 112 is formed at a lower portion of the main body 102, and a compressor 114 for compressing a refrigerant, a condenser 116 for handling a heat exchange of the refrigerant and a cooling fan 118 for blowing to the condenser 116 the fluid for the heat exchange are installed in the machine room 112. Also, an fluid compressor 120 generating compressed fluid supplied to the fluid pressure cylinder 108 is installed in the machine room 112.

The fluid compressor 120 is connected to the fluid pressure cylinder 108 by an fluid supply pipe 122, and an open and close valve 124 for handling an opening and closing operation of the fluid supply pipe 122 is installed at the fluid supply pipe 112. The open and close valve 124 and the fluid compressor 120 are controlled by a controller.

The lift frame 106 includes shelves 130 formed as a multilayer for loading the basket and a supporting plate 132 formed at lateral surfaces of each shelf 130 for supporting the shelves 130.

A mounting portion 136 to which an operation rod 134 of the fluid pressure cylinder 108 is mounted is formed at an upper portion of supporting plate 132.

Lift rails 138 are installed at both sides inside the main body 102, and guide protrusions 140 formed at both sides of the lift frame 106 are inserted in the lift rails 138, thereby supporting the lifting of the lift frame 106.

The fluid pressure cylinders 108 are constructed as a pfluid and disposed vertically at both sides inside the main body 102. Each of the fluid pressure cylinder has a space into which the compressed fluid generated by the fluid compressor 120 is introduced, and the operation rod 134 is liftably mounted at an upper side of the fluid pressure cylinder 108 and is lifted by the compressed fluid. An end portion of the operation rod 134 is engaged with the mounting portion 136 of the lift frame 106 by a bolt 142.

Figure 11:
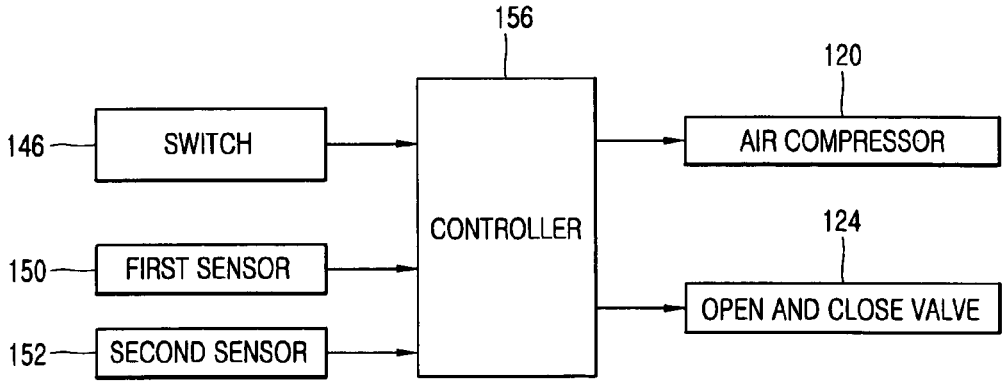
FIG. 11 is a block diagram which illustrates a control unit of the basket lift apparatus in accordance with the second embodiment of the present invention.

As shown in FIG. 11, the control unit includes a switch 146 installed at a front side of the main body 102 and manipulated by a user, a first sensor 150 mounted at an inner surface of an upper side of the main body 102 and sensing a maximum lifted state of the lift frame 106, a second sensor 152 mounted on a bottom of the main body 102 and sensing a bottom lowered state of the lift frame 106, and a controller 156 controlling the fluid compressor 120 and the open and close valve 124 according to signals applied from the switch 146, the first sensor 150 and the second sensor 152.

The operation of the basket lift apparatus in accordance with the second embodiment of the present invention having such a structure will now be described.

Figure 12:
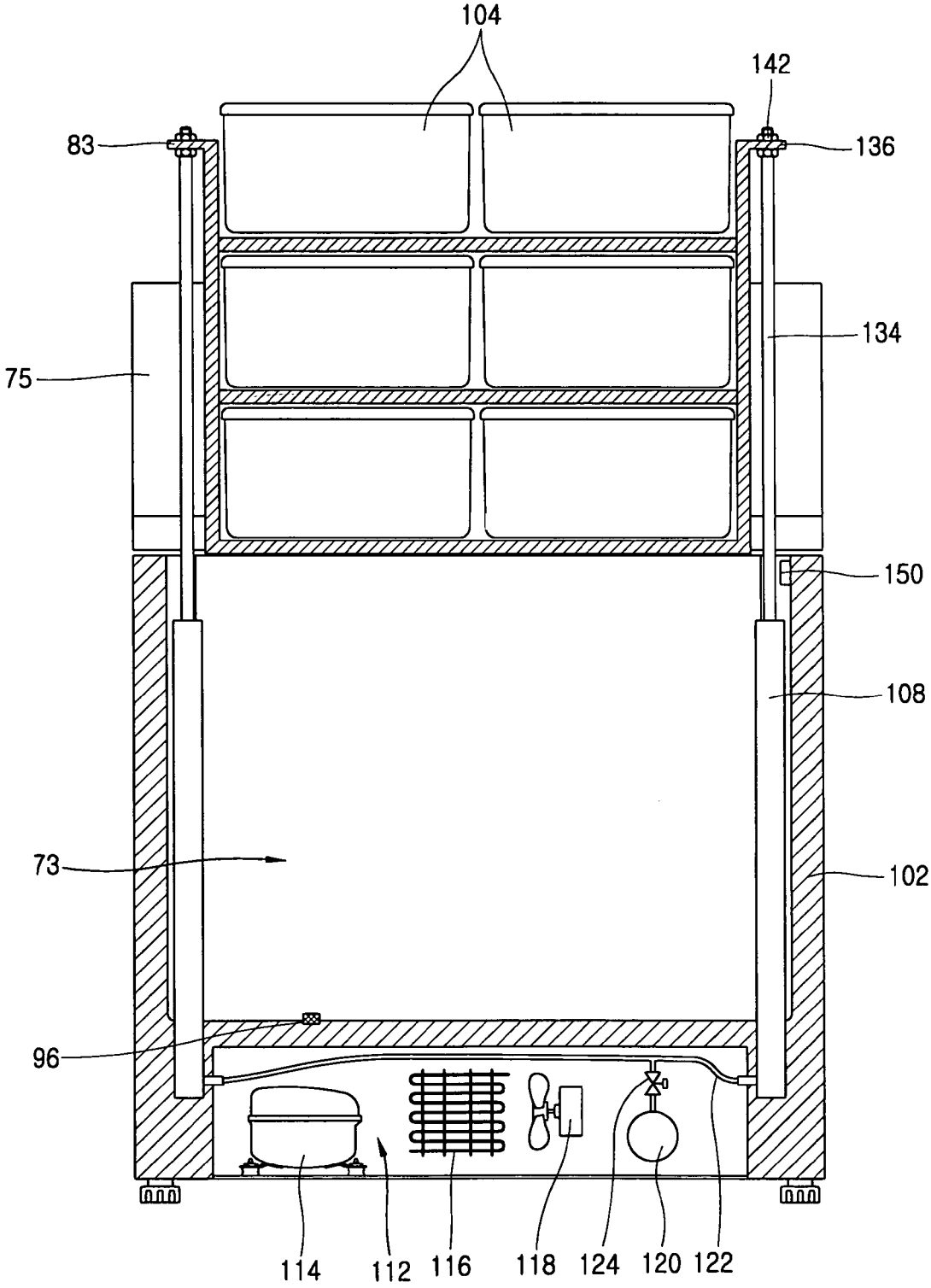
FIG. 12 is a view which illustrates an operation of the basket lift apparatus in accordance with the second embodiment of the present invention.

FIG. 12 shows an operation state of the basket lift apparatus in accordance with the second embodiment of the present invention.

When a user wants to take the basket 104 out of the cooling chamber 100, the user opens the door 110 and manipulates the switch 146. Then, the controller 156 operates the fluid compressor 120 and simultaneously applies power to the open and close valve 124 to operate the open and close valve 124, thereby opening the fluid supply pipe 122. Then, the compressed fluid generated from the fluid compressor 124 is supplied to the fluid pressure cylinder 108 through the fluid supply pipe 122, moving the operation rod 134 of the fluid pressure cylinder 108 in an upward direction and accordingly lifting the lift frame 106 upwardly. Then, the basket 104 put on the lift frame 106 is exposed to the outside of the main body 102. When the lift frame 106 reaches the highest position, the first sensor 150 senses that and applies a signal to the controller 156. Then, the controller 156 closes the open and close valve 124 to maintain a state of the compressed fluid being supplied to the fluid pressure cylinder 108 and simultaneously stops the operation of the fluid compressor 120.

In such a state, when food items are completely received in the basket 140 which has been drawn out, the user manipulates the switch 146. Then, the controller 156 operates the open and close valve 124 to open the fluid supply pipe 122, thereby discharging to the outside the compressed fluid filled in the fluid pressure cylinder 108, which leads to lowering of the lift frame 106.

Here, for the purpose of the slow lowering of the lift frame 106 on which the basket 104 is put, the controller 156 controls a degree to which the open and close valve 124 is opened, thereby slowly discharging the fluid filled in the fluid pressure cylinder 108.

When the lift frame 106 is completely lowered and contacts with a bottom surface of the main body 102, the second sensor 152 senses such contact and applies a signal to the controller 156. Then, the controller 156 cuts off power supply to the open and close valve 124 so that the open and close valve 124 closes the fluid supply pipe 122.

Effects of a refrigerator having a basket lift apparatus in accordance with the present invention constructed and operated in the aforementioned manner will now be described.

Because a basket disposed at a lower portion of the refrigerator is provided with a basket lift apparatus, the basket can be lifted upward when the basket is drawn out. Accordingly, the user can take out food items kept in the basket without bending his/her back, which enhances user's convenience.

Also, because a basket received in a refrigerator having an opened upper side is lifted upwardly of the refrigerator, food items kept in the basket can be easily taken out of the basket or food items can be easily put into the basket, which is very convenient to use.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a basket;

a body having a cooling chamber;

a base frame movable in back and forth directions of the body and having a door;

a lifting frame arranged at an upper surface of the base frame for the loading a basket, said lifting frame including a lower plate having an upper surface contacting a lower surface of the basket positioned thereon, a first side plate extending upwardly from said lower plate on a left side of said base frame and a first mounting portion extending leftward from said first side plate, and a second side plate extending upwardly from said lower plate on a right side of said base frame and a second mounting portion extending rightward from said second side plate;

a first lifting rail, coupled to the lifting frame and door, to guide the lifting frame to be lifted up and down, the first side plate including a first protrusion slidably coupled to the first lifting rail;

a second lifting rail, parallel to the first lifting rail and coupled to the lifting frame and door, to guide the lifting frame to be lifted up and down, the second side plate including a second protrusion slidably coupled to the second lifting rail, a lifting frame driving unit mounted at left and right sides of the base frame and connected to the left and right sides, respectively, of the lifting frame for lifting the lifting frame, said lifting frame driving unit including a first driving unit mounted on said first mounting portion and a second driving unit mounted on said second mounting portion;

a first control switch to generate a first control signal for simultaneously activating the first and second driving units to lift the lifting frame to a predetermined height; and a second control switch to generate a second control signal to lower the lifting frame to a retracted position from said predetermined height, wherein the first and second control switches are mounted on a surface of the refrigerator and adapted to be operated by a user in controlling movement of the lifting frame when the door is in an open position, wherein the refrigerator further comprises:

a first sensor to generate a first stop signal to prevent the lifting frame from continuing to be lifted during activation of the first control switch, the first sensor to generate the first stop signal to prevent the lifting frame from being lifted beyond said predetermined height; and a second sensor to generate a second stop signal to prevent the lifting frame from continuing to be lowered during activation of the second control switch, the second sensor to generate the second stop signal to allow the basket to be lowered to a position that allows the door to be closed, wherein the first sensor is coupled to the first lifting rail and the second sensor is coupled to the second lifting rail.

2. The refrigerator of claim 1, wherein the lifting frame driving unit is a fluid pressure cylinder.

3. The refrigerator of claim 2, further comprising a fluid compressor connected to the fluid pressure cylinder by a fluid supply pipe for supplying a compressed fluid to the fluid pressure cylinder.

4. The refrigerator of claim 1, wherein the lifting frame driving unit is a pneumatic cylinder.

5. The refrigerator of claim 2, wherein the fluid pressure cylinder has a lower end fixed to the base frame, an operation rod is mounted at an upper side of the fluid pressure cylinder, and the operation rod is fixed to the first or second mounting potion.

6. The refrigerator of claim 3, wherein the fluid supply pipe is provided with an opening/closing valve for opening and closing the fluid supply pipe.

7. The refrigerator of claim 3, wherein the fluid compressor is installed at a mechanic chamber formed at the body.

8. The refrigerator of claim 6, further comprising a control unit, coupled to the first and second control switches, for controlling the opening/closing valve and the fluid compressor.

9. The refrigerator of claim 6, further comprising:

a controller for controlling the opening/closing valve and the fluid compressor according to signals applied from one or more of the first and second switches, the first sensor, and the second sensor.

* * * * *